US008162178B2

(12) United States Patent
Ligny

(10) Patent No.: US 8,162,178 B2
(45) Date of Patent: Apr. 24, 2012

(54) EXPIRATION AFTER FIRST USE TIMER FOR A DISPENSER

(75) Inventor: Jean-Jacques Ligny, Evreux (FR)

(73) Assignee: Valois SAS, Le Neubourg (FR)

( * ) Notice: Subject to any disclaimer, the term of this patent is extended or adjusted under 35 U.S.C. 154(b) by 1094 days.

(21) Appl. No.: 11/993,501

(22) PCT Filed: Jun. 23, 2006

(86) PCT No.: PCT/EP2006/063507

§ 371 (c)(1),
(2), (4) Date: Dec. 21, 2007

(87) PCT Pub. No.: WO2006/136608

PCT Pub. Date: Dec. 28, 2006

(65) Prior Publication Data

US 2010/0147878 A1 Jun. 17, 2010

(30) Foreign Application Priority Data

Jun. 23, 2005 (FR) ..... 05 51722

(51) Int. Cl.
*B67D 7/24* (2010.01)

(52) U.S. Cl. ..... 222/30; 222/153.06; 222/638; 368/12; 368/108; 116/200

(58) Field of Classification Search ..... 222/30, 222/153.06, 167, 649, 23–24, 41, 153.13, 222/638; 116/206, 278; 368/10, 12; 604/187, 604/189, 192

See application file for complete search history.

(56) References Cited

U.S. PATENT DOCUMENTS

| | | | | |
|---|---|---|---|---|
| 4,673,074 | A * | 6/1987 | McCormick | 194/236 |
| 4,746,035 | A * | 5/1988 | Anderson et al. | 222/153.06 |
| 4,991,755 | A | 2/1991 | Grusmark | |
| 5,219,098 | A * | 6/1993 | Tada | 222/153.06 |
| 5,797,344 | A * | 8/1998 | Ramsey et al. | 116/206 |
| 5,862,101 | A * | 1/1999 | Haas et al. | 368/327 |
| 5,953,288 | A | 9/1999 | Chappell | |
| 6,110,152 | A * | 8/2000 | Kovelman | 604/232 |
| 6,378,906 | B1 * | 4/2002 | Pennaz | 283/81 |
| 6,869,421 | B2 * | 3/2005 | Hanley | 604/295 |
| 2003/0099157 | A1 * | 5/2003 | Quine | 368/10 |

FOREIGN PATENT DOCUMENTS

| | | |
|---|---|---|
| CA | 2 353 350 A1 | 1/2003 |
| GB | 2 306 707 A | 5/1997 |
| WO | 03/007088 A2 | 1/2003 |

* cited by examiner

*Primary Examiner* — Kevin P Shaver
*Assistant Examiner* — Andrew Bainbridge
(74) *Attorney, Agent, or Firm* — Sughrue Mion, PLLC

(57) ABSTRACT

A fluid dispensing device, in at least one embodiment containing medication typically have a shelf life and separately an expiration date after first being opened, as this exposure created by opening or sing the container for the first time raises the chance of contamination dramatically. A time indicator is situated so that as the container is opened for the first time, a timer displays the expiration date and time of the container. The time indicator can not be reset once it is triggered. In one embodiment, the indicator is triggered as the container is actuated by a rotational movement.

15 Claims, 2 Drawing Sheets

EXPIRATION AFTER FIRST USE TIMER FOR A DISPENSER

The present invention relates to a fluid dispenser device including actuator means that can be actuated in such a manner as to cause fluid to be dispensed. Advantageous fields of application of the present invention are the fields of perfumery, cosmetics, or even pharmacy. In such fields, the dispensed fluid should be more or less viscous, e.g. as for perfumes, lotions, creams, gels, pomades, etc.

It is very common to use fluid dispenser devices having actuator means that are displaceable axially or in turning. By way of example, mention can be made of dispenser devices using pumps or valves, and provided with actuator means in the form of a pusher that can be pressed by means of one or more fingers so as to actuate the pump or the valve. As a result, the optionally-metered fluid is dispensed through a dispenser orifice. By way of example, the fluid can be collected by the user or it can be applied directly on an application surface such as the skin, the hair, the lips, clothes, etc. Dispenser devices are also known in the form of pots having a portion that can be turned, and it is by turning said portion that fluid is dispensed through a dispenser orifice from which the user can collect the fluid. Either way, it is the displacement of the actuator means that causes the fluid to be dispensed.

Some fluids are particularly fragile or sensitive: for example, they can deteriorate or alter in nature when coming in contact with air, or quite simply over time. There is thus a risk of dispenser devices of such fluids being used when the fluid no longer conforms to optimum, appropriate, or healthy use.

An object of the present invention is to remedy the above-mentioned prior-art drawback by defining a fluid dispenser device that is suitable for minimizing the risks of using such a device containing fluids that are out-of-date.

To achieve this object, the present invention proposes a fluid dispenser device including actuator means that can be actuated so as cause fluid to be dispensed, the device being characterized in that it is provided with non-reinitializable time-indicator means that are suitable for providing a visual indication that is representative of the passage of a period of time following a one-off initialization.

The indicator means can thus provide an indication that relates to the maximum length of time the dispenser device can be used by indicating the moment when the fluid becomes out-of-date, for example. The indication is visual, i.e. perceptible to the eye, and for example it can be in written form, comprising alphabetical, numerical, alphanumerical, or non-alphanumerical signs, or in the form of different colors or different shades of color. The indicator means advantageously comprise a single trigger member that is actuated once so as to initialize monitoring the passage of time, and a display member that provides the visual indication. Thus, the display member provides no information until the trigger member has been actuated. Initialization is thus necessary to start monitoring the time that is then visible on the display member. Thereafter, it is no longer possible to reinitialize triggering, which is therefore a one-off event.

According to a very advantageous characteristic of the invention, the single trigger member is actuated once by the actuator means during their first actuation. Rather than require the user to initialize the indicator means by performing a specific manipulation, it is the first actuation of the actuator means that triggers the trigger member once and for all, and thus initializes the indicator means. Thus, initializing the indicator means is automatic and one-off, without the user realizing it. The user thus cannot forget to initialize the indicator means. It is guaranteed that the indicator means will be activated regardless of the use to which the dispenser device is put. The visual indication provided on the display member provides the user with information about the date on which the dispenser device was used for the first time, and thus information about when the fluid has gone beyond its time limit.

In an embodiment of the invention, the actuator means are axially displaceable down and up along an axial path, the trigger member being positioned on said axial path. This configuration is typically a dispenser device provided with a dispenser pusher.

In another embodiment of the invention, the actuator means are displaceable in turning around a circular path, the trigger member being positioned on said circular path. This configuration is typically a pot that is actuated by turning. Advantageously, the actuator means include a control element that is displaced around the circular path and that comes into engagement with the trigger member.

According to another particularly advantageous characteristic of the invention, the dispenser device further includes first-use safety means that prevent the actuator means from being actuated, such that the indicator means cannot be initialized. The combination of first-use safety means and time-indicator means mounted on a fluid dispenser device can be protected as such, without it being necessary for the dispenser device to include actuator means. The first-use safety means make it possible to prevent the indicator means from being initialized, which initialization will thus not take place until after the first-use safety means have been destroyed by the user, when the user wishes to use the dispenser device for the first time.

In a practical embodiment, the dispenser device includes a pump or a valve, the actuator means comprising a pusher that is axially displaceable so as to dispense the fluid through a dispenser orifice. The dispenser device advantageously includes a fastener ring, the pusher being movable axially relative to the ring, the pusher penetrating into the ring or surrounding the ring, the indicator means being triggered by the relative displacement of the pusher relative to the ring, the indicator means being mounted on the ring or the pusher. The fastener ring preferably includes an outer wall that is visible and an inner wall, the display member being disposed on the outer wall, and the trigger member projecting radially inwards from the inner wall into the axial displacement path of the pusher.

In another embodiment of the invention, the dispenser device includes a fluid reservoir of variable volume, the actuator means including a rotary knob that is suitable for causing a reduction in the volume of the reservoir, in such a manner as to dispense the fluid through a dispenser orifice.

The invention is described more fully below with reference to the accompanying drawings which show two embodiments of the invention by way of non-limiting example.

Figures 1, 2:
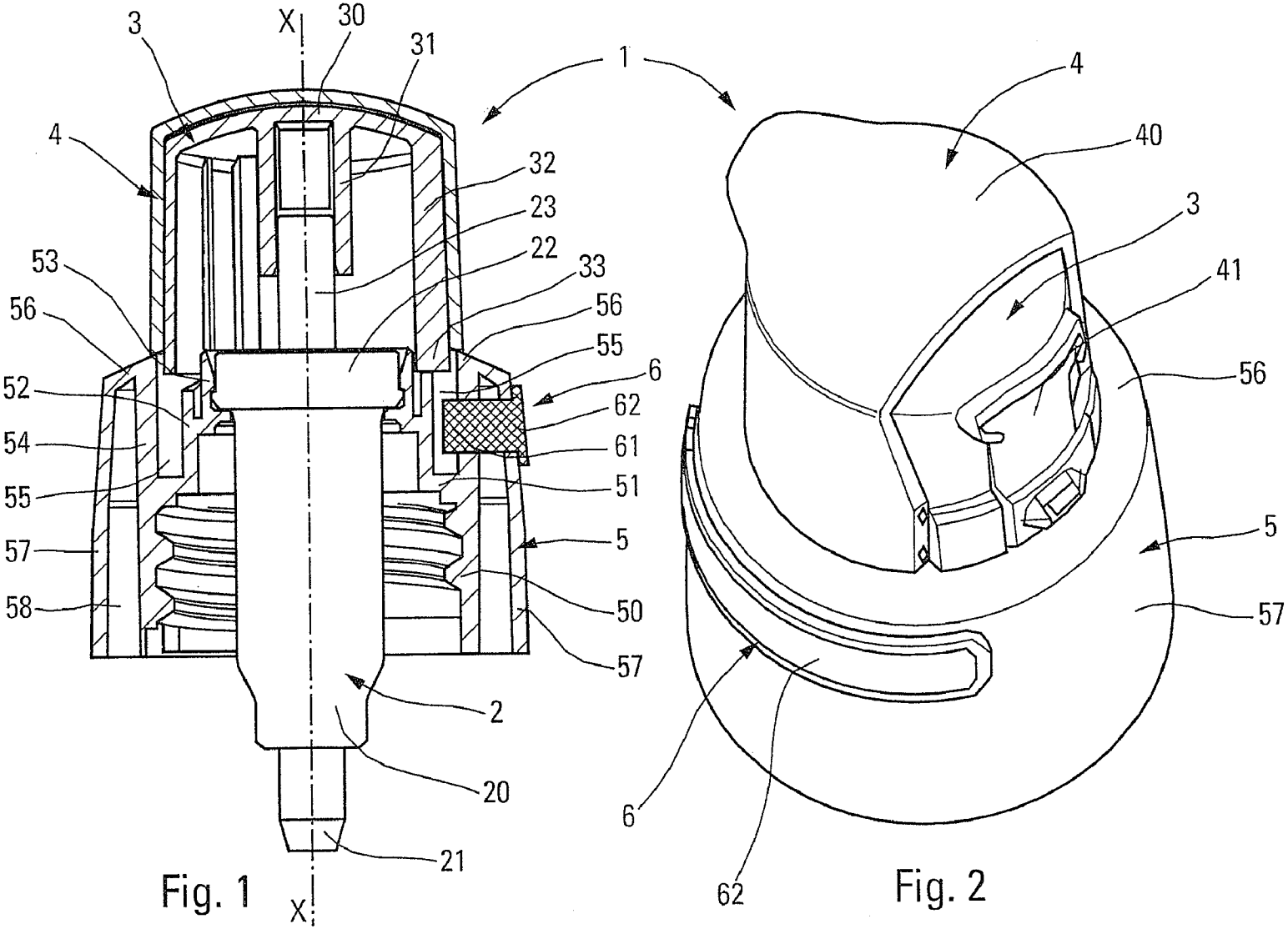
FIG. 1 is a vertical section view through a fluid dispenser device constituting a first embodiment of the invention.
FIG. 2 is a perspective view of the FIG. 1 dispenser device.

Reference is made firstly to FIGS. 1 and 2 in order to describe in detail the structure and the functioning of the fluid dispenser device constituting the first embodiment of the invention. The dispenser device is a pump or valve dispenser 2 that can be actuated by means of a pusher 3. The dispenser device includes fastener means 5 for fastening the pump or the valve to the opening of a reservoir (not shown). The dispenser device can be considered as being the dispenser as a whole, including the reservoir, or it can be considered as being merely the pump or the valve, its pusher, and its associated fastener means, not including the fluid reservoir. The reservoir can be of any kind, of variable or constant volume, and it can be made of any appropriate material, such as plastics material, glass, or metal.

The dispenser device shown in FIG. 1 thus comprises a pump or a valve 2, a pusher 3, and fastener means 5 that are in the form of a fastener ring. The dispenser is further provided with first-use safety means 4 that are associated with the pusher 3.

In conventional manner, the pump or valve 2 includes a body 20 that forms an inlet 21 for coming into communication with the inside of the reservoir so as to be able to take the fluid. The fluid penetrates inside the body 20 through said inlet 21. The inlet 21 can optionally be provided with a dip tube that extends inside the reservoir. At its top end, the body 20 forms a flange 22 that serves to fasten the pump or valve 2 in the fastener ring 5. Beyond the flange 22, the pump or valve includes an actuator rod 23 that is axially displaceable down and up along the longitudinal axis X shown in FIG. 1. Thus, the actuator rod 23 can be driven to a greater or lesser extent into the body 20. The actuator rod 23 is connected to a piston (not shown) that is displaceable in leaktight sliding contact inside the body 20. The purpose of the piston is to reduce the volume of a chamber, and thus put the fluid under pressure. The fluid under pressure can thus flow through the actuator rod 23 that has a flow channel formed therein. This is an entirely conventional design for a pump or a valve as used in the fields of perfumery, cosmetics, or even pharmacy.

The pusher 3 is mounted on the free end of the actuator rod 23 by means of a connection sleeve 31 that is fitted around the rod. The sleeve 31 forms an internal section of channel that serves to connect the actuator rod 23 to a dispenser orifice (not shown) formed by the pusher. In addition, the pusher includes a bearing surface 30 that intersects the axis X, and on which the user can press by means of one or more fingers so as to displace the pusher, and thus drive the actuator rod 23 into the body 20. The actuator rod 23 and the pusher 3 are returned to their rest position shown in FIG. 1 by a return spring (not shown) that is housed inside the body 20. The pusher 3 also includes a peripheral lateral skirt 32 that extends downwards from the outer periphery of the bearing surface 30. The lateral skirt 32 terminates at its bottom end by a control edge 33 having a function that is explained below. It should also be observed that the control edge 33 presents increased thickness, such that it comes into abutment, via its radially inner zone, against the fastener ring 5, as described below. This is the locked rest position into which the pusher cannot be actuated. The pusher is advantageously mounted in rotary manner on the actuator rod 23, such that it can turn about the axis X. This enables the pusher to be turned in such a manner as to disengage the thick portion formed by the edge 33 from its abutment against the ring, and thus enables the pusher to be actuated axially.

The fastener ring 5 includes a fastener bushing 50 that is for coming into engagement with an opening of a receptacle or reservoir (not shown). In the embodiment shown in FIG. 1, the fastener bushing 50 presents an internally-threaded wall that is suitable for coming into engagement with an externally-threaded neck of a reservoir. Naturally, it is possible to imagine other types of fastening for the bushing 50 that are suitable for co-operating with an opening of a reservoir. For example, it is possible for the bushing 50 to be provided with a bead or with snap-fastener heads that is/are suitable for coming into engagement below an outer peripheral reinforcement formed by a reservoir neck. Beyond the bushing 50, the ring 5 forms a turret 54 that advantageously extends upwards in register with the bushing 50. The turret 54 constitutes an inner wall of the ring. It is extended at its top end by a rim 56 that extends outwards from the top end of the turret 54. In the present embodiment, the rim 56 slopes a little outwards and downwards. The rim 56 forms a peripheral ring, as can be seen in FIG. 2. The rim 56 then extends downwards, forming a covering hoop 57 that extends in substantially coaxial manner around the bushing 50 and the turret 54. More precisely, the covering hoop 57 constitutes the visible outer wall of the ring, and advantageously presents a shape that is more or less bullet shaped. It should thus be observed that a substantially annular gap 58 is formed between the hoop 57 and both the bushing 50 and the turret 54. The ring 5 also includes a radial shelf 51 that extends radially inwards from the point where the bushing 50 joins the turret 54. The radial shelf 51 is for coming to bear against the top annular edge of the opening of the reservoir. The shelf 51 then extends upwards so as to define a collar 52 that internally forms receiver means 53 for receiving the flange 22 of the body 20 of the pump 2. By way of example, the receiver means can be snap-fastener means. It should also be observed that a housing 55 is formed between the turret 54 and the collar 52. The housing is open upwards and is for receiving the peripheral skirt 32 of the pusher 3. It should be observed that the bottom end of the skirt 32 is already engaged inside the housing 55, even in the rest position. It can easily be understood that by pressing on the pusher, the skirt 32 penetrates further inside the housing 55, possibly until it comes into abutment against the shelf 51. It should also be observed that the top end of the collar 52 forms an abutment end at the edge 33 that presents increased thickness. As mentioned above, the increase in the thickness of the edge 33 is only local, and by turning the pusher a little about its axis X, it is possible to disengage the edge 33 from the top end of the collar 52, thereby enabling the pusher 3 to be displaced axially. Consequently, the engagement of the thick edge 33 with the top end of the collar 52 constitutes locking means for locking the pusher in its rest position. The purpose of this is to avoid any accidental or involuntary actuation of the dispenser device that would lead to unwanted dispensing of the fluid. Such a fluid dispenser device is entirely conventional in the fields of perfumery, cosmetics, or even pharmacy.

The dispenser device in FIGS. 1 and 2 further includes first-use safety means 4 that are in the form of a cover 40 that surrounds the pusher 3, at least in part. The cover 40 is provided with a release member 41 that can advantageously be detached from the cover 40 so as to enable the cover 40 to be removed from the pusher 3. Until the release member 40 is removed, the pusher 3 is held captive inside the cover 40. The pusher is thus in its rest position. It should be observed in FIG. 1 that the bottom peripheral edge of the cover 40 comes into abutment against the rim 56, which guarantees that the pusher 3 is not actuated. The cover 40 equipped with its release member 41 enables the user to verify very easily whether the dispenser device has already been used. If the release member 41 is intact, this indicates to the user that the cover 40 has never been removed from the pusher 3. The cover 40 thus performs a first-use safety function. In addition, in the present embodiment, even after the member 41 has been removed, the cover 40 can be removed and then replaced on the pusher 3. The cover 40 thus performs three functions, namely a first-use safety function, a function of constituting a protective cap that can be put back into position, and a locking or blocking function for locking or blocking the pusher in its rest position.

In the invention, the dispenser device is further provided with time-indicator means 6 that are suitable for providing a visual indication that is representative of the passage of a period of time since being initialized. In other words, in order to provide an indication of time, the time-indicator means must be initialized or triggered. To this end, the time-indicator means comprise a trigger member 61 and a display member 62 that provides the visual indication that can be seen or read by the user. The time-indicator means 6 can be disposed anywhere on the fluid dispenser device, namely on the pusher 3, on the ring 5, or even on the reservoir (not shown). However, it is more advantageous to dispose the time-indicator means 6 on the ring 5, as shown in FIGS. 1 and 2. The display member is in the form of a flexible strip that is applied on the covering hoop 57, extending over a fraction of its circumference. It is also possible to provide a display member that extends vertically. It is the change in color or in appearance of the display member that provides the visual indication to the user of the passage of time. By way of example, it is possible to use time-indicator means such as those described in document WO 03/007088. The display member thus extends over the outside wall of the covering hoop 57, but the trigger member 61 extends through the hoop 57 and through the turret 54 so as to project inside the housing 55. The trigger member 61 is sensitive to pressure, such that when it is flattened or deformed, it triggers the initialization of the indicator means that cause the appearance of the display member to change progressively. Given that the trigger member 61 is positioned in the housing 55, it is disposed in the actuation path of the pusher, or more precisely in the path followed by the bottom edge 33 of the skirt 32. Once the cover 40 has been removed and the pusher has been unlocked by turning it, it is possible to press on the pusher so as to displace it axially downwards along the axis X, causing the bottom edge 33 to penetrate into the housing 55. It can thus easily be understood that the edge 33 comes to press, even sideways, against the trigger member 61, thereby causing the time-indicator means to be initialized. Naturally, it is possible for the dispenser device not to be provided with locking means in the form of increased thickness of the edge 33 that comes to bear against the top end of the collar 52. It is also possible for the dispenser device not to be provided with first-use safety means. However, they are preferred, and the combination of first-use safety means with time-indicator means constitutes an advantageous characteristic of the invention. The disposition of time-indicator means 6 on the ring 5 is particularly advantageous since it requires no modification to the dispenser device. Use is made of the housing 55 that is conventionally present to dispose the trigger means in the actuation path of the pusher.

Although the present invention applies to any dispenser device, it is advantageous for the time-indicator means to be triggered by actuation of the pusher 3 that constitutes the actuator means of the pump 2. The pusher 3 thus performs two functions, namely actuating the pump, and actuating the trigger member 61. Thus, while the dispenser device is being used for the first time, the time-indicator means are initialized by the user in a manner that is entirely automatic. The user is not even aware that the time-indicator means have been initialized by actuating the pusher.

It is also possible to envisage that the indicator means are triggered or initialized by turning the pusher about the axis X so as to unlock it. In this event, the indicator means are initialized just before the fluid is dispensed for the first time by pressing on the pusher.

Figure 4:
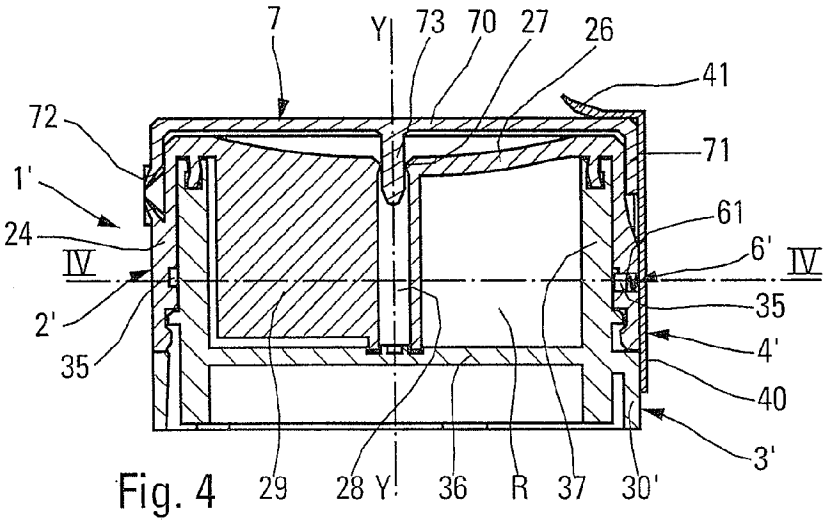
FIG. 4 is a vertical section view through the FIG. 3 dispenser device.
Figure 5:
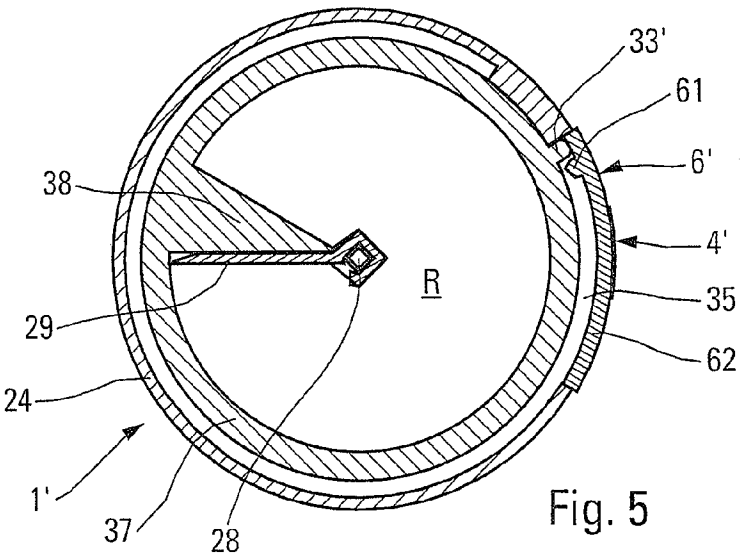
FIG. 5 is a horizontal cross-section view through the FIG. 3 dispenser device.
Figure 3:
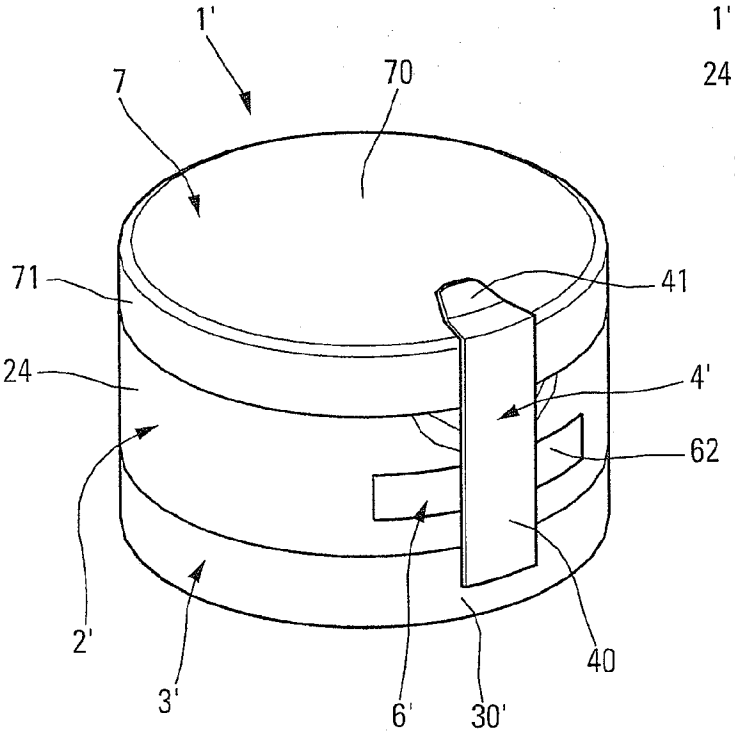
FIG. 3 is a perspective view of a fluid dispenser device constituting a second embodiment of the invention.

Reference is made below to FIGS. 3, 4, and 5 in order to describe the second embodiment of the invention. In this embodiment, the fluid dispenser device 1' is in the form of pot that defines a reservoir R for containing the fluid. The fluid is dispensed from the reservoir R by turning. Advantageously, the dispenser device 1' is constituted by only two parts that are fitted together. The dispenser device 1' is further provided with first-use safety means 4' that are in the form of a tear-off safety strip 40 provided with a pull tab 41. Apart from the first-use safety means 4', the two component parts of the pot are for turning relative to each other about an axis Y that passes substantially through the axial center of the pot. The pot thus includes a cover 2' that is mounted on a pump body 3'. The pump body 3' includes a pot bottom 36 and a peripheral side wall 37 that is cylindrical in shape. Furthermore, the pot body 3' includes a rotary actuator knob 30' via which the user can hold the pot body 3' and cause it to turn relative to the cover 2', as described below. The pot body 3' also forms a stationary wall 38 that extends from the side wall 37 towards the axial center of the pot, as can be seen in FIG. 5. Advantageously, the wall 38 is in the shape of a slice of pie. The cover 2' includes a skirt 24 in rotary engagement around the wall 37 of the pot body 3'. The skirt 24 extends just above the rotary actuator knob 30'. The skirt 24 can include holding means for holding it on the pot body 3', the holding means nevertheless enabling the skirt 24 to be turned on the pot body. At its top end, the skirt 24 is connected to a disk 26 that comes to close the volume formed by the bottom 36 and the side wall 37 of the pot body. The inside space created in this way serves as a reservoir R. The disk 26 is formed with a dispenser orifice 27 that is advantageously situated in completely axial manner. The cover 2' also includes a movable scraper wall 29 that extends radially outwards from the axis Y. This wall is visible in FIGS. 4 and 5. In the initial position, the movable wall 29 bears against the stationary wall 38. The reservoir is thus at maximum capacity. By turning the knob 30' relative to the skirt 24, the movable wall 29 is displaced, moving away from the stationary wall 38. This causes a reduction in the working volume of the reservoir R containing a fluid that must thus flow out through an outlet duct 28 formed by the cover 2'. The outlet from the duct 28 is formed by the dispenser orifice 27. The fluid is thus dispensed on the disk 26 that advantageously has the shape of a concave dish that makes it easier for the user to collect the fluid. Advantageously, the cover 2' is further provided with a lid 7 that is advantageously made integrally with the cover 2'. The lid 7 comprises a top wall 70 and a peripheral edge 71 that comes into engagement around the skirt 24. The edge 71 is connected to the skirt 24 by a single-part hinge 72. Furthermore, the lid 7 can form a closure pin 73 that is suitable from coming into leaktight engagement inside the dispenser orifice 27.

After opening the lid 7 by pivoting it about the hinge 72, it is possible to cause the actuator knob 30' to turn in such a manner as to dispense the fluid onto the disk 26.

The safety strip 40 can straddle the actuator knob 30' and the skirt 24. The strip 40 can even extend over the edge 71 of the lid, and even over part of the top surface 70 of the lid, as can be seen in FIG. 3. The pull tab 41 can be situated on the lid. By way of example, the strip 40 can be adhesively bonded on the pot. It can be removed by taking hold of the traction tab 41. However, when it is in place, it serves firstly to prevent the knob 30' from turning relative to the skirt 24, and secondly to prevent the lid 7 from opening. When it is in place, the strip provides a clear indication to the user that the pot has never been opened. In another embodiment of the invention, the pot 1' includes time-indicator means 6' that can be similar or identical to the indicator means 6 of the first embodiment of FIGS. 1 and 2. More particularly, the indicator means 6' can comprise a trigger member 61 and a display member 62. The display member 62 can provide a visual indication to the user by changing in appearance, by changing color, or by changing color shade. The trigger member 61 is suitable for being deformed or pushed in, and that can cause the display means to be initialized and so as to begin the change in color of the display member 62. The display member 62 is disposed on the outside wall of the skirt 24, extending over a fraction of its periphery. The trigger member 61 is in the form of a projection projecting into a peripheral groove 35 formed in the inside wall of the skirt 24. In addition, the side wall 37 of the pump body 3' forms a control lug 33' that is also housed in the groove 35. The lug 33 can thus come into engagement with the trigger member 61 in such a manner as to push it in or deform it, thereby initializing the indicator means. With reference to FIG. 5, it can be seen that the groove 35 does not extend over the entire periphery, but is interrupted over a peripheral segment that corresponds approximately to the width of the stationary wall 38. In the initial position, before the first actuation, the lug 33 is in abutment against the beginning of the groove 35, i.e. against the skirt 24. The lug 33 is thus disposed between the end of the groove 35 and the projection 61 that acts as a trigger member for triggering the indicator means 66. By displacing the skirt 24 relative to the wall 37, the lug 31 immediately flattens the trigger member 61. This initializes the indicator means 6'. Then, the lug 33 can continue to be displaced along the groove 35 until it reaches the other end.

Once again, it is the actuation of the actuator means of the pot formed by the pump body 3', and more precisely by the actuator knob 30', that causes both the fluid to be dispensed for the first time, and the indicator means 6' to be triggered. Naturally, it is possible to imagine that the indicator means 6' are not triggered by the actuator means of the pot. This would thus require the user to perform a particular manipulation in order to initialize the indicator means. By way of example, it is possible to envisage that the indicator means are initialized by opening the lid, advantageously while it is being pivoted.

In the two embodiments described, the time-indicator means provide a visual indication that is representative of the period of use of the fluid. This period begins at the single initialization that is performed during the single triggering of the indicator means. No subsequent reinitialization is possible. It can be seen when the end of this period has been reached, which indicates that the fluid has reached its time limit. In other words, monitoring the passage of time on the display member can be initialized only once, and once started it is impossible to stop. The time-indicator means can also be referred to as a "time-limit", "consume by", or "use by" indicator.

The invention claimed is:

1. A fluid dispenser device including actuator means that can be actuated so as cause fluid to be dispensed, comprising a non-reinitializable time-indicator means for providing a visual indication representative of the passage of a period of time following a first initialization of the non-reinitializable time-indicator means;

wherein the non-reinitializable time-indicator means comprises a single trigger member that is actuated once so as to initialize monitoring the passage of time and a display member that provides the visual indication; and wherein the single trigger member is actuated once by the actuator means during the first actuation.

2. A fluid dispenser device according to claim 1, in which the actuator means are axially displaceable down and up along an axial path, the trigger member being positioned on said axial path.

3. A fluid dispenser device according to claim 1, in which the actuator means are displaceable in turning around a circular path, the trigger member being positioned on said circular path.

4. A fluid dispenser device according to claim 3, in which the actuator means include a control element that is displaced around the circular path and that comes into engagement with the trigger member.

5. A fluid dispenser device according to claim 1, further including first-use safety means that prevent the actuator means from being actuated, such that the indicator means cannot be initialized.

6. A fluid dispenser device according to claim 1, including a pump or a valve, the actuator means comprising a pusher that is axially displaceable so as to dispense the fluid through a dispenser orifice.

7. A fluid dispenser device according to claim 6, including a fastener ring, the pusher being movable axially relative to the ring, the pusher penetrating into the ring or surrounding the ring, the indicator means being triggered by the relative displacement of the pusher relative to the ring, the indicator means being mounted on the ring or the pusher.

8. A fluid dispenser device according to claim 1, comprising a fastener ring configured to attach the dispenser to a reservoir, in which the fastener ring includes an outer wall that is visible and an inner wall, the display member being disposed on the outer wall, and the trigger member projecting radially inwards from the inner wall into the axial displacement path of the pusher.

9. A fluid dispenser device according to claim 1, including a fluid reservoir of variable volume, the actuator means including a rotary knob that is suitable for causing a reduction in the volume of the reservoir, in such a manner as to dispense the fluid through a dispenser orifice.

10. A dispenser device according to claim 1, in which the display member provides a visual indication in the form of a progressive change in color or in appearance.

11. A dispenser device according to claim 10, in which the display member includes a flexible strip that is applied on a visible outside surface of the dispenser device.

12. A fluid dispenser device comprising:

an actuator that causes fluid to be dispensed, and a non-reinitializable time-indicator that provides a visual indication representative of the passage of a period of time following a first initialization of the non-reinitializable time-indicator;

the indicator comprises a single trigger member that is actuated once so as to initialize monitoring the passage of time and a display member that provides the visual indication; and the single trigger member is actuated once by the actuator during the first actuation.

13. The fluid dispenser device according to claim 12, wherein the trigger member is sensitive to pressure, such that when deformed, the trigger is actuated so as to initialize monitoring the passage of time.

14. The fluid dispenser device according to claim 13, wherein the actuator comprises a pusher that is displaceable so as to dispense the fluid through a dispenser orifice, and the trigger is disposed in an actuation path of the pusher.

15. The fluid dispenser device according to claim 12, wherein the display member is a flexible strip.

* * * * *